US007021370B2

(12) United States Patent
Papapanu et al.

(10) Patent No.: US 7,021,370 B2
(45) Date of Patent: Apr. 4, 2006

(54) FIN-AND-TUBE TYPE HEAT EXCHANGER

(75) Inventors: Steven James Papapanu, Lockport, NY (US); Longhu Li, Getzville, NY (US)

(73) Assignee: Delphi Technologies, Inc., Troy, MI (US)

( * ) Notice: Subject to any disclaimer, the term of this patent is extended or adjusted under 35 U.S.C. 154(b) by 276 days.

(21) Appl. No.: 10/626,029

(22) Filed: Jul. 24, 2003

(65) Prior Publication Data

US 2005/0016718 A1 Jan. 27, 2005

(51) Int. Cl.
*F28D 1/04* (2006.01)

(52) U.S. Cl. ..... 165/151; 165/152; 62/290; 62/515

(58) Field of Classification Search ..... 165/150, 165/151, 152; 62/290, 515
See application file for complete search history.

(56) References Cited

U.S. PATENT DOCUMENTS

| | | | | | |
|---|---|---|---|---|---|
| 4,434,844 | A | | 3/1984 | Sakitani et al. | 165/151 |
| 4,550,776 | A | | 11/1985 | Lu | 165/151 |
| 4,614,230 | A | * | 9/1986 | Sakuma et al. | 165/151 |
| 4,691,767 | A | * | 9/1987 | Tanaka et al. | 165/151 |
| 4,709,753 | A | * | 12/1987 | Reifel | 165/125 |
| 4,723,600 | A | * | 2/1988 | Yokoyama et al. | 165/151 |
| 4,738,225 | A | * | 4/1988 | Juang | 122/367.3 |
| 4,830,102 | A | * | 5/1989 | Bakay et al. | 165/151 |
| 5,099,914 | A | * | 3/1992 | Reifel | 165/151 |
| 5,203,403 | A | * | 4/1993 | Yokoyama et al. | 165/151 |
| 5,509,469 | A | | 4/1996 | Obosu | 165/151 |
| 5,692,561 | A | * | 12/1997 | Kang et al. | 165/151 |
| 5,730,214 | A | | 3/1998 | Beamer et al. | 165/152 |
| 5,887,649 | A | * | 3/1999 | Kim | 165/151 |
| 5,975,200 | A | * | 11/1999 | Kato et al. | 165/151 |
| 6,227,289 | B1 | * | 5/2001 | Yokoyama et al. | 165/151 |
| 6,334,326 | B1 | * | 1/2002 | Kang et al. | 62/290 |

* cited by examiner

*Primary Examiner*—Terrell McKinnon
(74) *Attorney, Agent, or Firm*—Patrick M. Griffin

(57) ABSTRACT

A heat exchanger having fins disposed adjacent to each other with tubes passing through the fins to interconnect the fins. Louvers are formed in each of the fins with each louver extending at an angle with respect to the fins. An upstream portion of the interconnected fins define an incoming airflow side of the heat exchanger and a downstream portion of the interconnected fins define an outgoing airflow side of the heat exchanger. The louvers define a first bank of louvers formed in each of the upstream portions of the fins facing the incoming airflow side of the heat exchanger. The louvers also define a second bank of louvers formed in each of the downstream portions of the fins facing the incoming airflow side of the heat exchanger. Hence, all of the louvers on the fins are facing the same direction for minimizing the air pressure drop, while increasing a heat transfer between the fins, tubes, and the air flow.

14 Claims, 3 Drawing Sheets

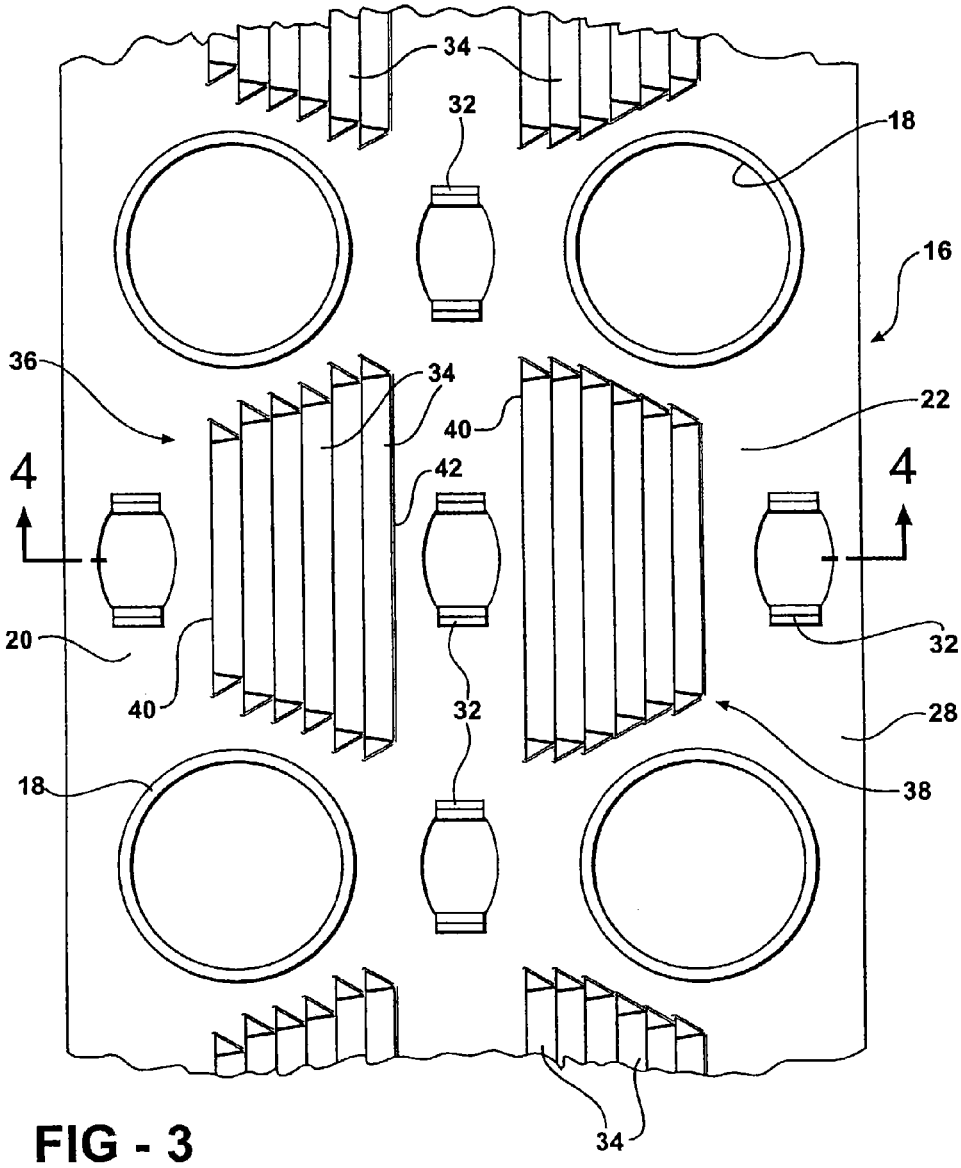
FIG - 3
FIG - 4
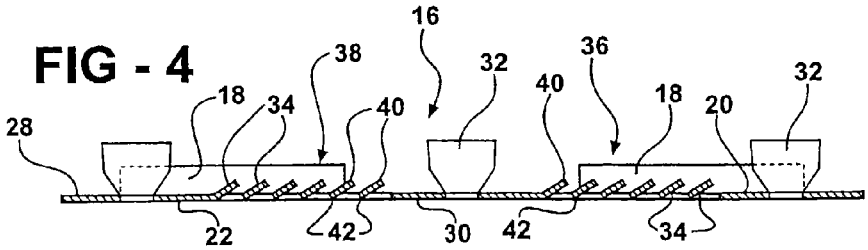

FIN-AND-TUBE TYPE HEAT EXCHANGER

BACKGROUND OF THE INVENTION

1. Field of the Invention

The subject invention relates to heat exchangers of the fin-and-tube type with an improved louver configuration.

2. Description of Related Art

Fin-and-tube type heat exchangers are well known in the art. These heat exchangers having a number of fins with heat transfer tubes passing therethrough. The fins typically incorporate a number of louvers to redirect and mix the air flow across the fins to increase the heat transfer between the surfaces of the heat exchanger, which include the surfaces of the fins and the outside surfaces of the tubes, and the air flow. One issue that arises when disrupting the air flow is a pressure drop across the fins. A significant increase in the pressure drop across the fins is the penalty paid for the increased heat transfer.

Accordingly, there has been much development in louver designs to balance the heat transfer and air pressure drops in an attempt to obtain the optimum heat exchanger design. Some examples of prior art attempts are disclosed in U.S. Pat. Nos. 4,434,844; 4,550,776; 5,099,914; 5,509,469; and 5,730,214. Many of these prior art designs have louvers facing in opposite directions from an incoming flow of air across the heat exchanger. Still others have louvers facing in numerous different lateral, longitudinal, and angular directions to the incoming flow of air. Although these designs may provide some advantages, the louver configurations are complex and expensive to manufacture and do not optimize the heat transfer between the surfaces of the heat exchanger and the air flow.

Accordingly, it would be desirable to optimize the heat transfer between the surfaces of the heat exchanger and the air flow with a simplified less expensive louver design.

SUMMARY OF THE INVENTION AND ADVANTAGES

A fin-and-tube type heat exchanger comprising a plurality of fins disposed adjacent to each other. Each of the fins define a plane and have an upstream portion and a downstream portion. A plurality of louvers are formed in each of the fins with each louver extending at an angle with respect to the planes of the fins. A plurality of tubes pass through the plurality of fins interconnecting the fins wherein the upstream portions of the plurality of interconnected fins define an incoming airflow side of the heat exchanger and the downstream portions of the plurality of interconnected fins define an outgoing airflow side of the heat exchanger. The plurality of louvers define a first bank of louvers formed in each of the upstream portions of the fins facing the incoming airflow side of the heat exchanger. The plurality of louvers also define a second bank of louvers formed in each of the downstream portions of the fins facing the incoming airflow side of the heat exchanger such that all of the louvers are facing the same direction toward the incoming airflow side whereby the louvers effectively redirect and mix an incoming flow of air and minimize an air pressure drop across the fins for increasing a heat transfer between the tubes, fins, and flow of air.

Accordingly, the subject invention provides a simplified louver design for optimizing the heat transfer between the surfaces of the heat exchanger and the air flow. More specifically, the subject invention increases heat transfer while actually reducing the air pressure drop.

BRIEF DESCRIPTION OF THE DRAWINGS

Other advantages of the present invention will be readily appreciated as the same becomes better understood by reference to the following detailed description when considered in connection with the accompanying drawings wherein:

FIG. 3 is a top view of a partially fragmented fin; and

FIG. 4 is a cross-sectional view taken along line 4–4 of FIG. 3.

DETAILED DESCRIPTION OF THE INVENTION

Figure 1:
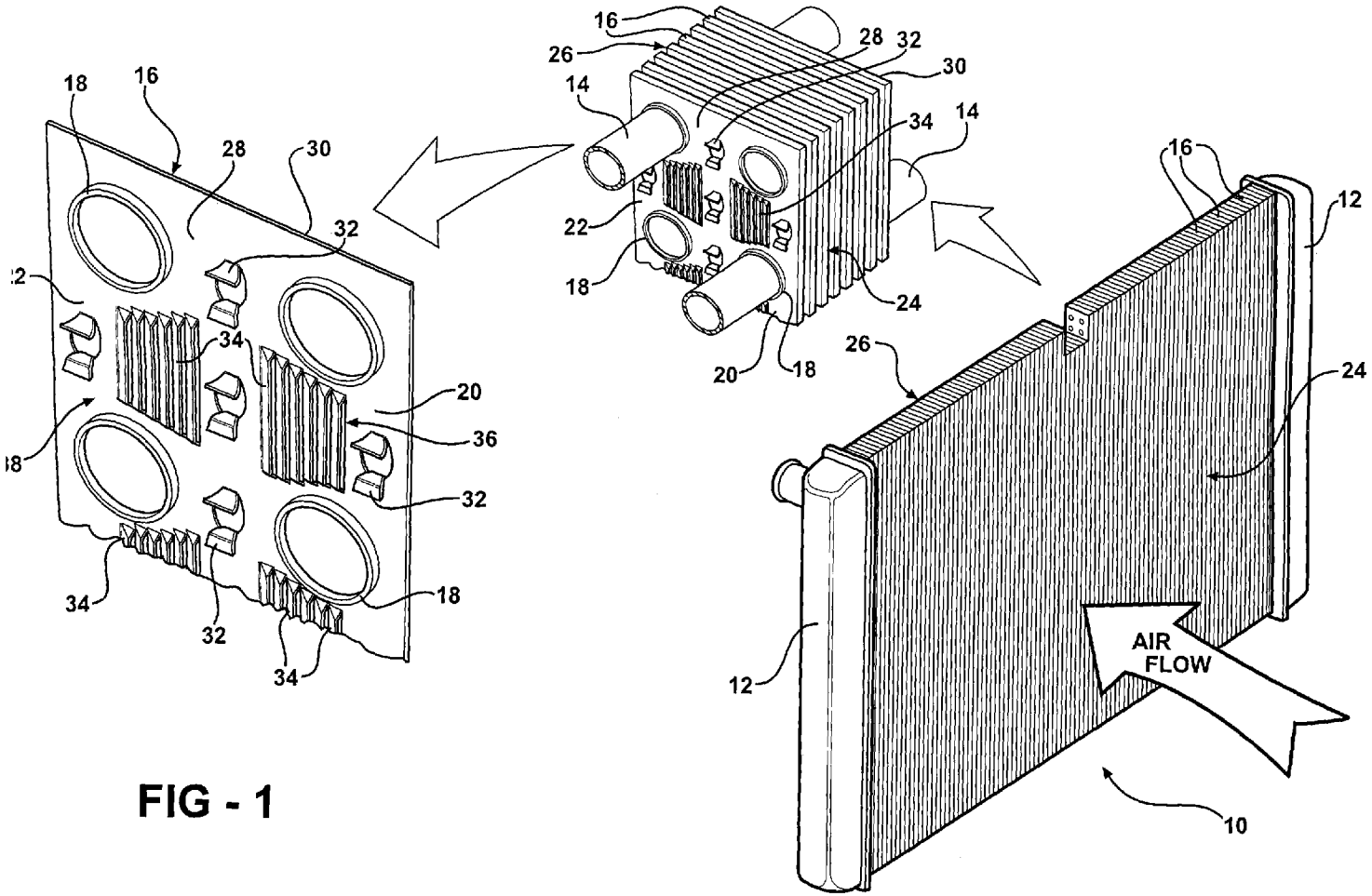
FIG. 1 is a perspective view of a heat exchanger with a partially fragmented grouping of fins being exploded from the heat exchanger and a partially fragmented fin being exploded from the grouping of fins.

Referring to the Figures, wherein like numerals indicate like or corresponding parts throughout the several views, a heat exchanger is generally shown at 10 in FIG. 1. The heat exchanger 10 includes a pair of manifolds 12 and a plurality of tubes 14. The tubes 14 are interconnected at opposite ends to the manifolds 12 to pass coolant between the manifolds 12. The heat exchanger 10 also includes a plurality of fins 16 disposed adjacent to each other. The plurality of tubes 14 pass through the plurality of fins 16 for interconnecting the fins 16 together and mounting the fins 16 to the heat exchanger 10. In particular, the fins 16 define collars 18 with the tubes 14 being received within and fixedly secured to the collars 18. This general configuration of a heat exchanger defines what is known in the art as a fin-and-tube type heat exchanger. It should be appreciated that the exact configuration of the manifolds 12, tubes 14, and fins 16, could be of any suitable design without deviating from the scope of the subject invention.

The plurality of fins 16 are disposed adjacent to each other with each of the fins 16 defining a plane and having an upstream portion 20 and a downstream portion 22. The upstream portions 20 of the plurality of interconnected fins 16 define an incoming airflow side 24 of the heat exchanger 10. Similarly, the downstream portions 22 of the plurality of interconnected fins 16 define an outgoing airflow side 26 of the heat exchanger 10. As shown in FIG. 1, the upstream portions 20 of the fins 16, as well as the incoming airflow side 24 of the heat exchanger 10, are orientated to face an incoming air flow. Each of the fins 16 also includes a first outer surface 28 and a second outer surface 30. Spacers 32 are preferably mounted to each of the fins 16 for maintaining proper distances between adjacent fins 16. Even more preferably, the spacers 32 extend outwardly from the first outer surface 28 and are integrally formed within the fins 16. It should be appreciated that the spacers could be eliminated without deviating from the scope of the subject invention.

Figure 2:
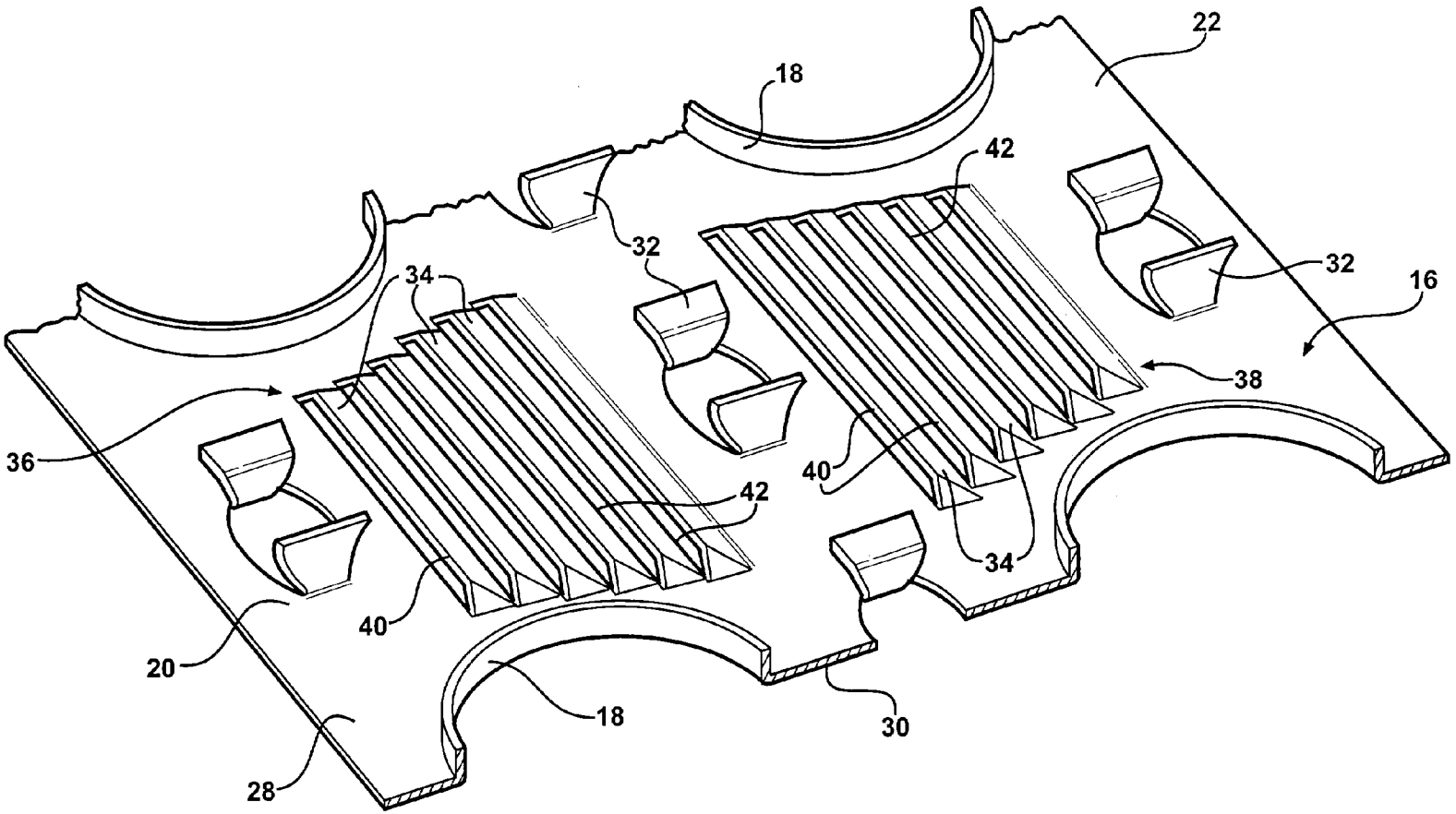
FIG. 2 is a perspective view of a partially fragmented fin.

Referring also to FIGS. 2-4, the fins 16 will now be discussed in greater detail. A plurality of louvers 34 are formed in each of the fins 16 with each louver 34 extending at an angle with respect to the planes of the fins 16. The plurality of louvers 34 define a first bank of louvers 36 formed in each of the upstream portions 20 of the fins 16 facing the incoming airflow side 24 of the heat exchanger 10. The plurality of louvers 34 also define a second bank of louvers 38 formed in each of the downstream portions 22 of the fins 16 facing the incoming airflow side 24 of the heat exchanger 10. Hence, all of the louvers 34 are facing the same direction toward the incoming airflow side 24. In particular, each of the louvers 34 includes a leading edge 40 and a trailing edge 42 with the leading edge 40 facing the incoming airflow side 24 of the heat exchanger 10. The louvers 34 are designed to effectively redirect and mix an incoming flow of air to increase a heat transfer between the surfaces of the heat exchanger, such as the surfaces of the fins and outer surface of the tubes, and the air flow. The unique configuration of the louvers 34 also minimizes an air pressure drop across the fins 16 for optimizing the heat transfer between the tubes, fins and the air flow.

The preferred embodiment of the louvers 34 is now discussed in detail. It should be appreciated that one or more of the specific features subsequently discussed could be altered or eliminated without deviating from the overall scope of the subject invention. In particular, the louvers 34 of the first bank of louvers 36 are preferably arranged in parallel with each other. Similarly, the louvers 34 of the second bank of louvers 38 are preferably arranged in parallel with each other. Each of the louvers 34 also extend at a common angle with respect to the planes of the fins 16. In particular, the leading edges 40 of the louvers 34 extend a common distance from the corresponding plane of the corresponding fin 16. Specifically, each of the louvers 34 extends outwardly from only the first outer surface 28 such that the louvers 34 all extend in a common direction.

The first 36 and second 38 banks of louvers are designed to provide a grouping or series of louvers 34 located in a particular location in the fins 16. The banks of louvers 36, 38 define the trailing edge 42 of a first louver 34 being adjacent to a leading edge 40 of a second subsequent louver 34. The trailing edge 42 of the second louver 34 is in turn adjacent a leading edge 40 of a third subsequent louver 34 and so on until the final louver 34. The first 36 and second 38 banks of louvers are disposed between successive rows of tubes 14. The first 36 and second 38 banks of louvers also have a wedge shaped configuration with each of the louvers 34 of the first bank 36 having a different length from each other and each of the louvers 34 of the second bank 38 likewise having a different length from each other. Preferably, each of the louvers 34 also have a common width which further defines the common angle and outward distance from the plane of the fins 16. The length of each louver 34 is defined as the dimension between the two ends where the louver 34 is connected to the fin 16. The width of the louver 34 is defined as the dimension between the leading 40 and trailing 42 edges in the direction of airflow.

In the most preferred embodiment, the plurality of louvers 34 consist of a plurality of first 36 and second 38 banks of louvers. In other words, the only louvers 34 on the fins 16 are associated with the first 36 and second 38 banks of louvers. As illustrated, the first 36 and second 38 banks of louvers are orientated in a pair of columns. The columns have alternating tubes 14 and banks of louvers 36, 38. Although additional louvers 34 may alternatively be included on the fins 16, it is important that all of the louvers 34 face the same direction toward the incoming airflow side 24 of the heat exchanger 10. Further, the basic idea of the most preferred embodiment can be extended to fins that are deeper in the air flow direction. For example, there could be four rows of tubes 14 with four banks of louvers, etc. Also, while the most preferred embodiment shows the leading edges 40 of the louvers 34 extending a common distance from the plane of the fin 16, it is also possible for these distances to vary so long as the angle of all the louvers 34 is common. Additionally, the louvers 34 could also extend from both outer surfaces 28 and 30 of the fin 16 as long as the angle of all the louvers 34 is common.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A fin-and-tube type heat exchanger comprising:

a plurality of fins disposed adjacent to each other with each of said fins defining a plane and having an upstream portion and a downstream portion;

a plurality of louvers formed in each of said fins with each louver extending at an angle with respect to said planes of said fins;

a plurality of tubes passing through said plurality of fins interconnecting said fins wherein said upstream portions of said plurality of interconnected fins define an incoming airflow side of said heat exchanger and said downstream portions of said plurality of interconnected fins define an outgoing airflow side of said heat exchanger; and said plurality of louvers defining a first bank of louvers formed in each of said upstream portions of said fins facing said incoming airflow side of said heat exchanger and a second bank of louvers formed in each of said downstream portions of said fins facing said incoming airflow side of said heat exchanger such that all of said louvers are facing the same direction toward said incoming airflow side whereby said louvers effectively redirect and mix an incoming flow of air and minimize an air pressure drop across said fins for increasing a heat transfer between said tubes, said fins, and the flow of air;

wherein each of said fins includes a first outer surface and a second outer surface with each of said louvers extending outwardly from only said first outer surface such that said louvers all extend in a common direction.

2. A heat exchanger as set forth in claim 1 wherein said louvers of said first bank of louvers are arranged in parallel with each other.

3. A heat exchanger as set forth in claim 2 wherein said louvers of said second bank of louvers are arranged in parallel with each other.

4. A heat exchanger as set forth in claim 1 wherein said plurality of louvers consist of a plurality of first and second banks of louvers.

5. A heat exchanger as set forth in claim 1 wherein each of said louvers extend at a common angle with respect to said planes of said fins.

6. A heat exchanger as set forth in claim 1 wherein each of said louvers includes a leading edge and a trailing edge with said leading edge facing said incoming airflow side of said heat exchanger.

7. A heat exchanger as set forth in claim 6 wherein said leading edges of said louvers extend a common distance from said plane of said fin.

8. A heat exchanger as set forth in claim 6 wherein said trailing edge of a first louver is adjacent to a leading edge of a second subsequent louver in each of said first and second banks of louvers.

9. A heat exchanger as set forth in claim 1 wherein each of said louvers has a common width.

10. A heat exchanger as set forth in claim 9 wherein each of said louvers of said first bank have a different length from each other.

11. A heat exchanger as set forth in claim 9 wherein each of said louvers of said second bank have a different length from each other.

12. A heat exchanger as set forth in claim 1 wherein said fins further define collars with said tubes being received within and fixedly mounted to said collars.

13. A heat exchanger as set forth in claim 1 further including spacers mounted to each of said fins for maintaining proper distances between adjacent fins.

14. A heat exchanger as set forth in claim 13 wherein said spacers are integrally formed within said fins.

* * * * *